US009257246B2

(12) United States Patent
Hoepfl et al.

(10) Patent No.: US 9,257,246 B2
(45) Date of Patent: Feb. 9, 2016

(54) STEPPING SWITCH WITH VACUUM SWITCHING TUBES

(71) Applicants: Klaus Hoepfl, Maxhuette-Haidhof (DE); Silke Wrede, Zeitlarn (DE)

(72) Inventors: Klaus Hoepfl, Maxhuette-Haidhof (DE); Silke Wrede, Zeitlarn (DE)

(73) Assignee: MASCHINENFABRIK REINHAUSEN GMBH, Regensburg (DE)

( * ) Notice: Subject to any disclaimer, the term of this patent is extended or adjusted under 35 U.S.C. 154(b) by 76 days.

(21) Appl. No.: 14/346,720

(22) PCT Filed: Oct. 18, 2012

(86) PCT No.: PCT/EP2012/070681

§ 371 (c)(1),
(2) Date: May 23, 2014

(87) PCT Pub. No.: WO2013/075893

PCT Pub. Date: May 30, 2013

(65) Prior Publication Data

US 2014/0360983 A1 Dec. 11, 2014

(30) Foreign Application Priority Data

Nov. 23, 2011 (DE) ..... 10 2011 119 318

(51) Int. Cl.

| | |
|---|---|
| ***H01H 19/00*** | (2006.01) |
| ***H01H 21/00*** | (2006.01) |
| ***H01H 33/666*** | (2006.01) |
| ***H01H 3/42*** | (2006.01) |
| ***H01H 9/00*** | (2006.01) |
| ***H01F 29/04*** | (2006.01) |

(52) U.S. Cl.

CPC ..... *H01H 33/666* (2013.01); *H01F 29/04* (2013.01); *H01H 3/42* (2013.01); *H01H 9/0027* (2013.01); *H01H 9/0038* (2013.01); *H01H 2033/6667* (2013.01)

(58) Field of Classification Search

CPC ..... H01H 19/00; H01H 21/00; H01H 15/00; H01H 3/00; H01H 3/02; H01H 3/44; H01H 3/20; H01H 3/001; H01H 3/3031; H01H 3/3042; H01H 3/32; H01H 3/38; H01H 3/54; H01H 9/0044; H01H 9/0033; H01H 9/0038; H01H 69/00; H01H 71/00; H01H 71/02; H01H 71/0214; H01H 71/025; H01H 71/0264; H01H 71/0271; H01H 71/10; H01H 71/1072; H01H 71/128; H01H 71/50; H01H 71/52; H01H 71/521; H01H 71/522; H01H 71/523; H01H 71/524; H01H 73/06; H01H 73/24; H01H 73/38; H01H 73/50; H01H 73/60; H01H 2003/02

USPC ..... 200/11 TC

See application file for complete search history.

(56) References Cited

U.S. PATENT DOCUMENTS

| | | | | |
|---|---|---|---|---|
| 5,107,200 A | | 4/1992 | Dohnal | |
| 5,834,717 A | * | 11/1998 | Neumeyer | H01H 25/06 200/11 TC |
| 6,060,669 A | * | 5/2000 | Dohnal | H01H 9/0038 200/11 TC |

FOREIGN PATENT DOCUMENTS

| | | | | |
|---|---|---|---|---|
| DE | 3919596 A1 | * | 12/1989 | H01F 29/04 |
| DE | 4231353 A | | 4/1993 | |
| DE | 19821775 A | | 10/1999 | |

*Primary Examiner* — Edwin A. Leon
*Assistant Examiner* — Anthony R. Jimenez
(74) *Attorney, Agent, or Firm* — Andrew Wilford

(57) ABSTRACT

A tap changer with vacuum-switching tubes for controlling a transformer having taps has a selector for power-free selection of a one of the taps to be switched and a load-changeover switch for actual switching over from the connected tap to a new, pre-selected one of the taps. A first cam disk is fixed against rotation on a rotatable switch shaft, and a rocker lever arrangement has a first roller for actuating the vacuum-switching tubes. A second cam disk is also rotationally fixed on the switch shaft, and there are two further arms of U-shaped construction on the rocker lever arrangement. A lever has a free end provided with a second roller that co-operates with the second cam disk. This lever is between the further arms and mounted to be rotatable about an axis. A compression spring is provided between the lever and the further arms.

6 Claims, 1 Drawing Sheet

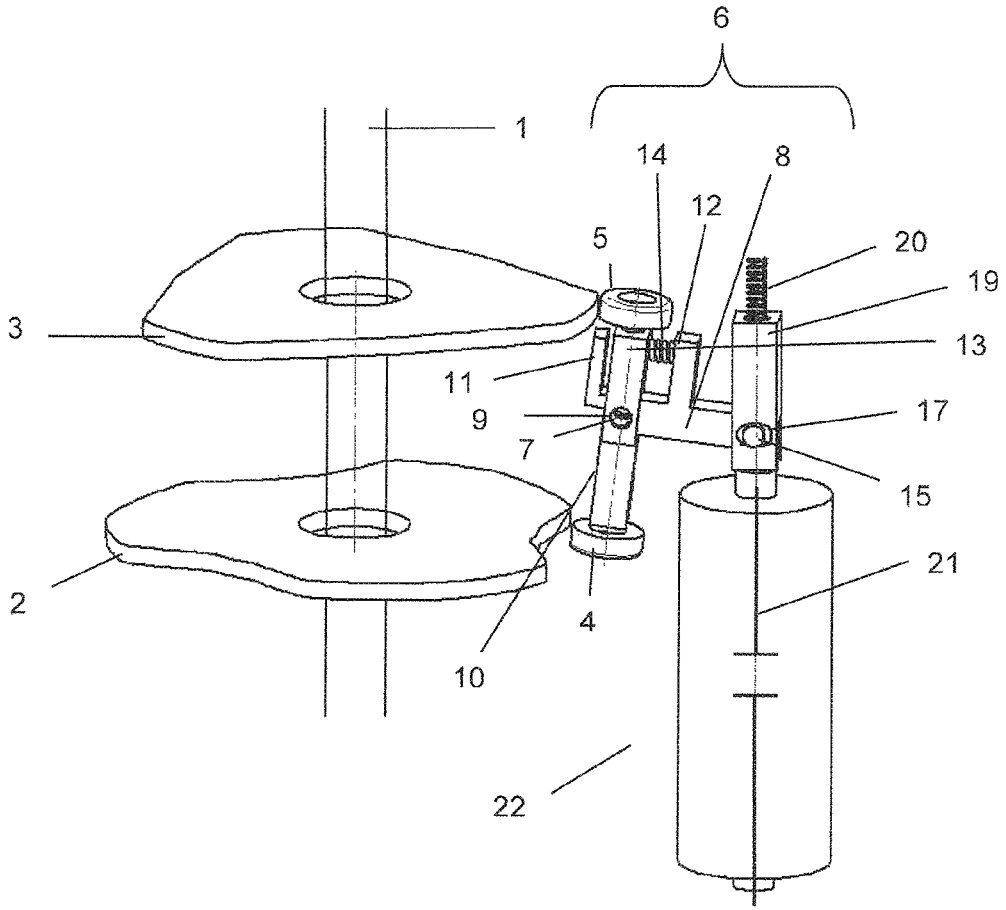
6
1
14
8
12
5
20
19
3
13
11
9
17
7
15
21
2
4
10
22

STEPPING SWITCH WITH VACUUM SWITCHING TUBES

CROSS REFERENCE TO RELATED APPLICATIONS

This application is the US-national stage of PCT application PCT/EP2012/070681 filed 18 Oct. 2012 and claiming the priority of German patent application 102011119318.2 itself filed 23 Nov. 2011.

FIELD OF THE INVENTION

The invention relates to a tap changer with vacuum-switching tubes having a selector for power-free selection of the respective winding tap to be switched to of the tapped transformer and a load-changeover switch for the actual switching from the connected to the new, pre-selected winding tap.

BACKGROUND OF THE INVENTION

Tap changers for uninterrupted changeover between different winding taps of tapped transformers have been in use in large numbers worldwide for many years. Such tap changers usually consist of a selector for power-free selection of the respective winding tap that is to be switched to, of the tapped transformer and a load-changeover switch for the actual switching from the connected to the new, preselected winding tap. The abrupt changeover usually takes place with the assistance of an force-storage device whose triggering rapidly rotates a switch shaft. In addition, the load-changeover switch usually comprises a contact switch s and a resistance switch. The contact switches in that case serve for direct connection of the respective winding tap with the load diverter and the resistance switches for temporary connection, i.e. bridging-over by one or more switch-over resistances.

In such a load-changeover switch of a tap changer, the vacuum-switching tubes are used for uninterrupted switching, is known from DE 195 10 809 [U.S. Pat. No. 5,834,717]. In that case respective cam disks are provided for each switching element to be actuated and each movement direction of the drive shaft. The respective ends of the individual cam disks have a defined profile that departs from the circular shape and that, on rotation of the switch shaft, actuate individual vacuum-switching tubes or also mechanical contacts.

In DE 42 31 353 A1, actuation of the individual switching tubes is effected by a switch shaft that is rotatable in both directions and that is rapidly rotated after triggering of a force-storage device. In that case, fixed on the switch shaft for actuation of the vacuum-switching tubes is a cam disk on whose end there is for each vacuum-switching tube a control cam in which a roller—that acts on the actuating lever of the associated vacuum-switching tube—is mechanically positively and constrainedly guided. The control cam is here realized in the form of a horizontal encircling groove that departs from a circular profile and in which the respective roller mechanically positively engages.

In addition, there is known from DE 40 11 019 [U.S. Pat. No. 5,107,200] a load-changeover switch that operates according to the reactor principle and in which the cam disk for actuation of the contacts does not have at the encircling end a profile departing from a circular shape, but possesses grooves of geometrically different design on the upper side and lower side thereof. A double-sided actuation of different switching elements with different switching sequence is possible with this known solution.

However, in different cases of use of such known tap changers with vacuum-switching tubes for regulation of power transformers a high surge voltage strength of up to 100 kV and significantly thereabove is required. Such undesired surge voltages whose level is essentially dependent on the construction of the tapped transformer and the winding parts between the individual winding taps, are on the one hand lightning surge voltages resulting from lightning strikes in the grid. On the other hand, switching surge voltages caused by unpredictable switching surges in the grid to be regulated can also occur.

If the tap changer has insufficient surge voltage strength a temporary tap short-circuit or undesired break-through of the ceramic or of the damping screens of vacuum-switching tubes in the load branch not conducting load current can happen that not only can cause long-term damage thereof, but also is undesirable in general.

This problem is solved in the prior art inter alia in that the movable plunger of the vacuum-switching tube, which is susceptible in terms of circuitry to this lightning surge voltage, is provided with a stroke of such a length, i.e. spacing between the contact surfaces of the co-operating fixed and movable plungers within the vacuum-switching tubes, that the dielectric spacings between the contact surfaces of the co-operating plungers are thereby dimensioned to be sufficiently large and as a consequence undesired arcing during a lightning strike surge cannot arise.

However, a disadvantage of the solution known from DE 42 31 353 A1 is that the required long stroke of the movable plunger requires a control cam with correspondingly large cam throws. This in turn presupposes within the load-changeover switch a large constructional space that, however, is often not available and from the technical aspect is a constructionally disadvantageous solution. Moreover, in each switchover process there is material erosion at contact surfaces of the contact system within the vacuum-switching tube caused by electric arcs that occur during mechanical separation of the contact surfaces of the vacuum-switching tube under load. DE 42 31 353 A1 does not offer a solution as to how compensation can be provided for the effects that are produced by material erosion of the contact surfaces on the actuating lever of the respective vacuum-switching tube and that with time produce tolerances within the contact system. This problem comes very much to the forefront due to the promised lengthy maintenance intervals of several hundred thousand switch-over actions per tap changer that manufacturers guarantee to customers in the case of a tap changer with vacuum-switching tubes.

DE 195 10 809 C1 does, in fact, compensate for tolerances arising due to material erosion at the contact surfaces in that here the actuating lever operatively connected with the movable plunger of the vacuum-switching tube applies the requisite contact force purely by a spring and not by mechanically constrained guidance. In that case the spring has, apart from its function of providing the required contact force, the further task of introducing the closing force to the actuating lever. In other words: the spring here has a double function of compensation for tolerances and application of the required contact force in the closed state of the vacuum-switching tubes. If in this solution known from DE 195 10 809 C1 the stroke of the movable plunger of the vacuum-switching tube is to be increased then a larger size compression spring with a spring rate corresponding therewith and greater spring travel is necessary for that purpose. However, in sum this causes a significantly increased expenditure of force for actuation of the vacuum-switching tubes and thus a more substantial dimensioning of the individual components that in turn is linked with significant disadvantages due to constructional and cost aspects. Since, as just described, the contact force of the contact surfaces of the vacuum-switching tube is limited to the spring force of the spring employed, in the case of a short-circuit load a transient lifting-off of the contact surfaces of vacuum-switching tube and thus an electrically undefined state within the power transformer can additionally arise.

OBJECT OF THE INVENTION

The object of the present invention is accordingly to provide a tap changer with vacuum-switching tubes of the kind described above that has a sufficiently high closing force of the vacuum-switching tube, even in the case of short-circuit loading, for a stroke that at the same time is significantly increased and in addition significantly reduces the tolerances that arise over time due to material erosion, of the contact system of the vacuum-switching tube.

SUMMARY OF THE INVENTION

According to the invention this object is fulfilled by a tap changer in which, apart from the first cam disk—which is known from the prior art and which is provided at the drive shaft to be secure against relative rotation—for the force initiation of the opening stroke of the contact system of the vacuum-switching tube there is a second cam disk on the drive shaft to be secure against relative rotation and that by a spring/lever system provided at the rocker lever arrangement exerts a sufficiently high closing force on the movable plunger of the vacuum-switching tube even in the event of short-circuit loading and additionally enables compensation for a tolerance of the contact system.

In other words, now two parallel, spaced-apart cam disks departing from a circular profile are arranged at the switch shaft of the load-changeover switch to be secure against relative rotation, at the respective ends of which cam disks corresponding rollers roll along, under maintained contact, at least at a circular sector section of the corresponding end, wherein the rollers are in turn arranged at an angularly constructed rocker lever arrangement pivotable about an axis. As known from the prior art, the rocker lever arrangement in that case comprises a longitudinally extending main rocker lever with a first arm at which the first roller is arranged that rolls, under maintained contact, at least along a circular sector section of the end of the first cam disk. In addition, in accordance with the invention provided at the rocker lever arrangement on the side that is opposite the first arm, at the main rocker lever are two further arms that are of U-shaped construction and between which a lever similarly mounted to be rotatable about the axis is arranged, the second roller being fastened to the free end thereof and similarly rolling, under maintained contact, along at least one circular sector section of the end of the second cam disk, wherein a compression spring is so arranged between the lever and one of the further arms that a spring/lever system is thus created that exerts a sufficiently high closing force on the movable plunger of the vacuum-switching tube even in the case of short-circuit loading and additionally enables compensation for tolerance of the contact system.

BRIEF DESCRIPTION OF THE DRAWING

The invention shall be explained in more detail by way of example on the basis of a drawing whose sole FIGURE is a schematic illustration of a part of a tap changer according to the invention with vacuum-switching tubes.

SPECIFIC DESCRIPTION OF THE INVENTION

For reasons of clarity the drawing shows only the parts that are essential to the invention, of a tap changer according to the invention with vacuum-switching tubes. Description and illustration of features known per se and components not relevant to the substance of the invention have been dispensed with. In correspondence therewith the drawing shows a switch shaft driven by a spring force-storage device (similarly not illustrated) and on which two parallel, spaced-apart cam disks 2 and 3 departing from circular form, namely a first cam disk 2 and a second cam disk 3, are arranged to be secure against relative rotation. The profiled outer edges of the two cam disks 2 and 3 are, in the illustrated embodiment, arranged substantially in star shape, but oppositely by 180°, on the switch shaft 1. The number of cam disks used and the edge shapes thereof is dependent on the switching sequence on which the tap changer is based and the vacuum-switching tubes that are necessary for that purpose, per phase. The drawing is therefore to be used only as an example for understanding of the invention. Obviously, in accordance with the substance of the invention several vacuum-switching tubes per phase would also be actuatable. A typical switching process of a tap changer with several vacuum-switching tubes per phase is described for example in DE 10 2009 048 813 A1 of applicant.

Rollers 4 and 5 roll along at least a defined circular sector section of the corresponding co-operating edges of the first and second cam disks 2 and 3 and in turn are provided on an angularly constructed rocker lever arrangement 6. In which sub-regions of the ends the rollers 4 and 5 in detail co-operate with the first and second cam disks 2 and 3 during a changeover process can be inferred more specifically from the description below. The rocker lever arrangement 6 is mounted to be pivotable about an axis of an axle 7 and arranged within the load-changeover switch (not illustrated here). Moreover, the rocker lever arrangement 6 consists of a main rocker lever 8 that has on the side facing the drive shaft 1 an opening 9 in which the axle 7 can be rotatably received. A first arm 10, at the free end of which the first roller is arranged to be rotatably mounted, branches off from the main rocker lever 8 vertically downwardly from the opening 9, thus substantially parallel to the drive shaft 1.

Two further arms 11 and 12 that form a substantially U-shaped structure, additionally branch off the main rocker lever 8 at the side opposite the first arm 10. Provided in perpendicular prolongation of the first arm 10 between the two further arms 11 and 12 is a lever 13 that is similarly rotatable about the axis 7 and at the free end of which the second roller 5 is arranged to be rotatably mounted. In addition, a compression spring 14 is arranged between the third arm 12 and the lever 13. Moreover, mutually opposite pins 15 and 16, of which in the illustrated perspective view, however, only the pin 15 is visible, are provided at the end of the base support remote from the switch shaft 1. The pins 15 and 16 in that case engage in corresponding slots 17 and 18 of a perpendicular actuating lever 19 that is substantially parallel to the drive shaft 1, and that is mechanically linearly guided in its longitudinal direction, for example by a rail (not illustrated in more detail). Provided at the upper end of the actuating lever 19 is a compression spring 20 that is mechanically that is braced at its upper end whereas the lower end of the actuating lever 19 is operatively connected with the movable plunger 21 of a vacuum-switching tube 22. Considered overall, through the rocker lever arrangement 6 according to the invention there results a geometric construction in which through introduction of a force by the cam disks 2 and 3 ultimately due to lever effect a stroke larger by comparison with the prior art, in particular a multiple of that previously known, can be produced at the movable plunger 21 of the vacuum-switching tube 22.

The connected state of the vacuum-switching tube 22 is shown in the drawing. The contact members of the movable plunger 21 as well as of the fixed plunger thus produce an electrically conductive connection in the interior of the vacuum-switching tube 22. The end of the heart-shaped tip of the cam disk 3 presses the lever 13 the roller 5 against the spring force of the compression spring 14 in the direction of the further arm 22 so that the compression spring 14 thus stands under a degree of bias and ultimately exerts a closing force on the movable plunger 21 of the vacuum-switching tube 22 by the base support 8 and the actuating lever 19. If in the course of operation of the vacuum-switching tube 22 material erosion of the contact surfaces now occurs then tolerance compensation of the rocker lever arrangement 6 for the thus-changing travel relationships of the rocker lever arrangement 6 is ensured by the biasing of the compression spring 14 in co-operation with the further compression spring 20. In the connected state of the vacuum-switching tube 22 the roller 4 is at a certain spacing from the end of the corresponding cam disk 2. In the case of a changeover process, i.e. a rotational movement introduced to the switch shaft 1 by the force-storage device, the cam disks 2 and 3 connected with the switch shaft 1 to be secure against rotation relative thereto are rotatably moved. As soon as the roller 5 has rolled, under maintained contact, beyond the tip of the heart-shaped cam disk 3 the roller 5 comes out of contact with the end profile of the corresponding cam disk 3. Instead, at this point in time of the changeover process the roller 4 comes into contact with the end profile of the cam disk 2 corresponding therewith, rolls mechanically along this and thus moves the rocker lever arrangement 6 upwardly, i.e. opens the contacts of the vacuum-switching tube 22.

The invention claimed is:

1. A tap changer with vacuum-switching tubes for controlling a transformer having taps, the tap changer comprising:

a selector for power-free selection of a one of the taps to be switched, a load-changeover switch for actual switching over from the connected tap to a new, pre-selected one of the taps, the load-changeover switch having a rotatable switch shaft, a first cam disk fixed against rotation on the switch shaft, a rocker lever arrangement with a first roller for actuating the vacuum-switching tubes, a second cam disk rotationally fixed on the switch shaft, two further arms of U-shaped construction on the rocker lever arrangement, a lever having a free end provided with a second roller that co-operates with the second cam disk, the lever being between the further arms and mounted to be rotatable about an axis, and a compression spring between the lever and the further arms.

2. The tap changer with vacuum-switching tubes according to claim 1, further comprising:

laterally opposite pins that engage in corresponding slots of an actuating lever at the end of the rocker lever arrangement remote from the switch shaft.

3. The tap changer with vacuum-switching tubes according to claim 1, further comprising:

a further compression spring at the upper end of the actuating lever, a lower end of the actuating lever being operatively connected with a movable plunger of the vacuum-switching tube.

4. The tap changer with vacuum-switching tubes according to claim 1, wherein the profiled edges of the first and second cam disks are substantially star-shaped.

5. The tap changer with vacuum-switching tubes according to claim 1, wherein each switching tube co-operates with the two separate cam disks via the rocker lever arrangement.

6. The tap changer with vacuum-switching tubes according to claim 1, wherein the entire rocker lever arrangement is mounted to be rotatable about the axis.

* * * * *